US006076284A

United States Patent [19]

Terlizzi

[11] Patent Number: 6,076,284

[45] **Date of Patent: *Jun. 20, 2000**

[54] SHOE WITH SPLIT SOLE AND MID-SECTION REINFORCEMENT

[75] Inventor: John Terlizzi, Newmarket, N.H.

[73] Assignee: Ballet Makers, Inc., Totawa, N.J.

[ * ] Notice: Under 35 U.S.C. 154(b), the term of this patent shall be extended for 889 days.

[21] Appl. No.: 08/554,386

[22] Filed: Nov. 6, 1995

Related U.S. Application Data

[63] Continuation of application No. 08/210,352, Mar. 18, 1994, abandoned.

[51] Int. Cl.[7] ..... A43B 7/18; A43B 13/16

[52] U.S. Cl. ..... 36/103; 36/108; 36/88; 36/91; 36/99; 36/31; 36/45; 36/102

[58] Field of Search ..... 36/106, 88, 91, 36/99, 103, 31, 145, 113, 8.3, 25 R, 97, 170, 102

[56] References Cited

U.S. PATENT DOCUMENTS

| | | | |
|---|---|---|---|
| 4,497 | 5/1846 | Vetter | 36/7.1 R |
| 92,950 | 7/1869 | Foster . | |
| 252,778 | 1/1882 | Klein | 36/10 |
| 584,373 | 6/1897 | Kuhn . | |
| 797,966 | 8/1905 | Lange et al. | 36/97 X |
| 955,337 | 4/1910 | Lawlor | 36/105 |
| 1,239,411 | 9/1917 | Lynch | 36/170 |
| 2,132,523 | 10/1938 | Berry | 36/7.3 |
| 2,147,197 | 2/1939 | Glidden | 36/3 A X |
| 2,252,315 | 8/1941 | Doree | 36/9 R |
| 2,254,685 | 9/1941 | Jackson | 36/7.3 |
| 2,539,761 | 1/1951 | Whitman | 36/170 X |
| 2,660,813 | 12/1953 | Shapiro | 36/129 |
| 4,519,148 | 5/1985 | Sisco | 36/8.3 X |
| 4,541,186 | 9/1985 | Mulvihill | 36/114 |
| 4,542,598 | 9/1985 | Misevich et al. | 36/107 X |
| 4,554,749 | 11/1985 | Ostrander | 36/102 |
| 4,583,304 | 4/1986 | Spalding | 36/113 |
| 4,813,158 | 3/1989 | Brown | 36/50.1 X |
| 4,901,453 | 2/1990 | Gaynor | 36/113 |
| 4,944,099 | 7/1990 | Davis | 36/97 |
| 5,035,069 | 7/1991 | Minden | 36/113 |

FOREIGN PATENT DOCUMENTS

| | | |
|---|---|---|
| 3827807 | 12/1938 | Japan . |
| 4120008 | 9/1941 | Japan . |
| 44-17734 | 7/1969 | Japan . |
| 541404 | 6/1993 | Japan . |
| 2232057 | 12/1990 | United Kingdom . |

*Primary Examiner*—Paul T. Sewell
*Attorney, Agent, or Firm*—Ostrolenk, Faber, Gerb & Soffen, LLP

[57] ABSTRACT

A shoe, e.g. for dance or athletics, having a split sole, with a front portion at the front of the foot, a rear portion beneath the rear of the foot and no sole beneath the mid-section of the shoe upper at the mid-section of the foot, beneath the arch. To help support the foot and prevent sag of the mid-section of the shoe upper, a band of flexible, but non-stretchable, fabric is stitched inside the shoe upper to extend from the bottom of the shoe upper, up the sides of the shoe upper, to the top of the shoe upper. The stitched in material supports the mid-section of the bottom of the shoe upper against sagging, while permitting the foot to be flexed. If the shoe has a split top side of the upper and is closed or laced, the closing of the top of the shoe upper pulls up on the band.

16 Claims, 1 Drawing Sheet

22
24
26
10
28
40
44
12
42
34
14
18
16
32

10
42
18
32
34
37
40,41
36

41

SHOE WITH SPLIT SOLE AND MID-SECTION REINFORCEMENT

This is a Continuation of application Ser. No. 08/210,352, filed on Mar. 18, 1994, now abandoned.

BACKGROUND OF THE INVENTION

The present invention relates to a shoe with a split sole, particularly useful as a dance shoe, but also useful as an exercise shoe, and particularly relates to sag and stretch resistance of the mid-section of the shoe between its split sole regions.

A typical shoe, dance shoe or dance slipper, or athletic shoe has a sole that extends from the toe to the rear of the heel. For enhancing the flexibility of the shoe to enable the wearer's foot and the shoe to bend and flex more easily, it is known to split the outsole of the shoe between a front portion beneath the toes and the ball of the foot and a rear portion under the heel and to have no sole below the mid-section of the shoe. Instead, the more flexible material of the shoe upper or a similar material provides the connection at the mid-section of the shoe between the sole portions at the rear and the front of the shoe.

Examples of split sole shoes are seen in U.S. Pat. Nos. 4,519,148 and 4,554,749, which suggest a shoe or slipper that is usable in a dance application, and U.S. Pat. Nos. 4,541,186 and 4,542,598, which show an athletic shoe. In shoes of this type, beneath the wearer's foot at the mid-section of the sole, between the sole sections at the front and rear of the shoe, the material of the shoe upper wraps under the foot. The shoe upper also encloses the sides and top of the foot. This design of the upper provides whatever support for the foot the mid-section of the shoe would provide.

The material of which a shoe upper is comprised, typically leather or a fabric in a dance shoe, or another material, are flexible materials which enable the shoe to flex as the foot moves. But, another characteristic of the material of a shoe upper is that it is stretchable, either because it is an inherently stretchable or elastic material, as in some ballet slippers (see U.S. Pat. No. 4,554,749) or it is leather, which inherently stretches when the foot flexes or when laces on the shoe are secured. The flexible material of the shoe upper which is typically used at and under the mid-section of the shoe does not prevent the mid-section, which is not supported by a stiff sole material, from stretching, deforming or sagging, and the arch of the foot is typically not well supported at the mid-section of the shoe.

SUMMARY OF THE INVENTION

Accordingly, it is an object of the present invention to provide reinforcement to the underside at the mid-section of a shoe, slipper or sneaker which has separate front and rear sole sections.

Another object of the invention is to provide support to the mid-section of the wearer's foot in such a shoe.

A further object of the invention is to provide such support without interfering with the flexibility of the shoe which the split sole is intended to achieve.

According to the invention, a reinforcing band of a thin, flexible, but essentially non-stretchable material is attached to the body or upper of the shoe, passing under the foot at the mid-section of the shoe between the front and rear sole sections and wrapping up toward and at least partially around, if not completely around, the upper of the shoe generally at the mid-section of the shoe. While the shoe is being worn, the tendency of the bottom side of the shoe upper at the mid-section of the shoe to sag is countered by the stretch resistant material band affixed to it. Further, the fact that the reinforcing material is either wrapped completely around or at least extends well toward the top of the foot makes that band act like a strap to prevent sagging of the underside of the shoe upper at the mid-section, and this can also provide support to the arch of the foot.

In the preferred embodiment, the stretch resistant band is attached as a liner to the inside of the shoe at the mid-section between the front and the rear sole sections and extends around from the bottom of the shoe upper to the top. For example, the liner may be stitched to the inside of the shoe. The band may be in two obliquely inclined sections, each extending from somewhat below the foot opening at the bottom of the shoe upper and up over the shoe upper foward of the foot opening.

When the reinforcing band is used in a laced shoe, e.g. a sneaker, the band would extend up to the laced region at the top of a shoe, so that when the laces are tightened to draw the two sides of the split shoe upper together, this also pulls up on the band and perhaps even draws the band and the bottom of the shoe upper against the underside of the wearer's foot providing some arch support, which is typically absent from a shoe with a split sole.

Any typical, generally non-stretchable material may be used for the reinforcing band, including a non-stretchable fabric, such as nylon. Other such fabrics or liner materials would be apparent to one skilled in the art. The material of the band is at least as flexible as the material of the shoe upper, so as not to interfere with the flexing, but it is typically less stretchable and expandable than the shoe material to which it is attached, so as to reduce the tendency of the shoe material to stretch and particularly to sag at the mid-section of the shoe and to enhance the foot supporting ability of the mid-section of the shoe.

Other features and advantages of the present invention will become apparent from the following description of a preferred embodiment considered in conjunction with the accompanying drawings.

DETAILED DESCRIPTION OF THE INVENTION

Figure 1:
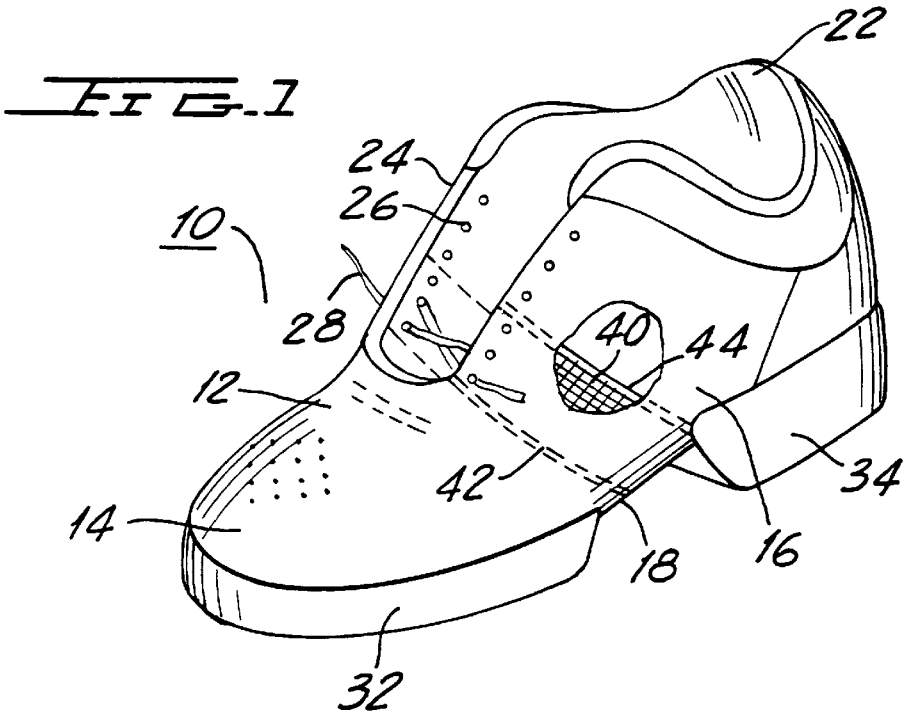
FIG. 1 is a perspective view of a shoe which has been provided with the present invention.
Figure 2:
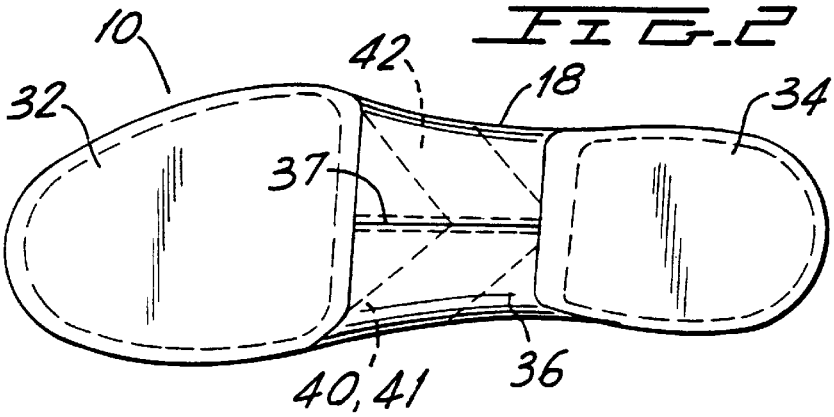
FIG. 2 is a bottom view of the shoe.
Figure 3:
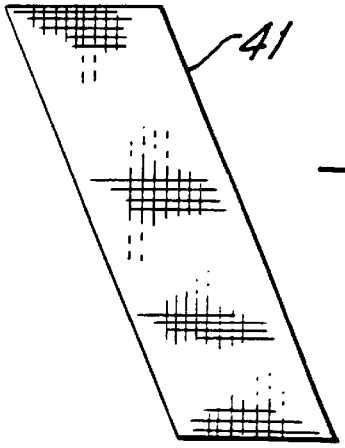
FIG. 3 is a view showing part of a reinforcing band.

The present invention is intended for use in a shoe having a split outsole or sole. The shoe may be a dancer's shoe or sneaker, an athletic shoe or sneaker or almost any other type of shoe having a split sole. Every type of shoe with which the invention is used has a split sole, including a front portion under the front of the foot, i.e. toes and ball of the foot and a rear portion under the heel of the foot. The shoe has a mid-section between the front and rear portions with no sole. The mid-section typically underlies the arch of the foot.

The invention is described herein as applied on a laceable dance sneaker. But, this is a mere example of one of many possible applications for the invention.

The illustrated shoe 10 is a dance sneaker. It includes a leather upper 12 which wraps over the top of the front of the foot at 14, over the side of the foot at 16 and wraps under the bottom of the foot at 18. The rear region of the shoe upper has a foot opening 22 where the foot is inserted and removed from the shoe. The top of the shoe upper forward of the opening 22 is itself split open at 24. Lace eyelets 26 are arrayed along the margins of the opening 24 and a lace 28 extends through the eyelets 26 and across the open region 24 of the shoe to lace up the shoe tight on the wearer's foot. This is typical of many shoes, of dance sneakers, of ballet shoes and the like. The invention is also applicable to shoes that have an integrated top, rather than a split top, and to shoes without laces.

A typical shoe has a sole that extends along the entire length of the underside of the shoe upper. The sole might have an additional slightly elevated heel portion beneath the rear of the foot, which is typical of most shoes. The sole portion that is typically beneath the mid-section of the foot stiffens the shoe making it difficult for the wearer of the shoe to bend the shoe significantly while wearing it. This restriction on bending is usually desirable, except in connection with certain types of dance or athletic activities where the wearer of the shoe wants to be able to bend his or her foot around the arch which is above the mid-section of the shoe.

To provide sufficient flexibility to the shoe to enable it to be bent, by typically bending the toe downward with reference to the heel and bending the arch sharply, but also possibly bending the shoe upwardly, it is known to provide a sole that is split between the front and the rear, having a thick and stiff front section 32 beneath at least the ball of the foot and likely also the toes and having a thick and stiff rear section 34 which at least extends beneath the heel of the foot under at least part of the foot opening 22. The underside 18 of the shoe upper at the mid section 36 between the front sole section 32 and the rear sole section 34 lacks any supporting sole beneath it. This gives the bottom 18 of the mid-section 36 of the shoe upper the flexibility to bend and flex easily. The shoe upper is stitched together to complete its bottom at seam 37.

Many typical shoe upper materials, such as leather or fabric, are stretchable and, especially with dance shoes and sneakers, are intended to be stretchable and elastic, so as to permit the wearer's foot to move within the shoe without hurting the foot or the shoe. At the underside of the shoe upper at the mid-section 36, the capability of the shoe material to stretch may cause the mid-section 36 of the shoe upper to sag down with the foot pressing down on it and it is unlikely to provide any arch support to the wearer. The invention is designed to avoid the effects of such sagging and/or stretching of the shoe upper material at the mid-section of the shoe.

A reinforcing band of a flexible but essentially non-stretchable material 40 is attached on the shoe upper, to wrap under the foot at the mid section 36 of the underside of the upper and to extend up the sides 16 of the shoe to the top 14 of the shoe upper.

The band 40 is wholly inside the shoe, and is not visible on the outside. Dashed lines indicate the band inside the shoe and the below described stitch lines for the band. As the shoe upper is tightened on the foot of the wearer, e.g. by tying the laces 28, the band 40 is held up toward the top of the shoe upper and in turn holds up the bottom 36 of the shoe upper against sagging or flexing downwardly. It may also cause the shoe upper to contact or support the arch of the wearer's foot.

Application of non-stretchable material at the underside of the foot in a shoe is known, e.g. an inserted or additional insole inside the shoe. Here the band of material extends not only under the foot, but wraps up the side of the shoe and to the top of the shoe upper.

The band does not extend forward of the mid-section of the foot and generally therefore would not cover either the toe portion or the heel portion of the foot and would terminate at the rear before the foot hole of the shoe.

In the illustrated embodiment, the band 40 is comprised of two sections 41, 42, each attached to the bottom of the shoe upper, each starting just forward of the rear section 34 of the sole at least partly below the foot opening 22 and each extending up a respective side 16 of the shoe and each inclined obliquely forwardly in the upward direction so that the band both underlies the arch of the foot and reaches to the laced up area 24, 26 of the shoe upper in front of the shoe opening 22. The band sections 41, 42 meet to define a V-shape for the band.

The band 40 is preferably installed on the inside of the shoe and to operate effectively, should be attached to the shoe at the bottom 18 of the shoe upper at the mid-section 36 of the shoe, and at the top 14 of the shoe upper and preferably also along the sides 16 of the shoe upper. In the illustrated example, the band sections 41, 42 are sewn along their edge margins at 43, 44 to the shoe upper material over the whole length of the band 41, 42. Fastening of the band to the shoe upper may be by other means, e.g. gluing. Alternately, the band might be wrapped around the outside of the shoe at the mid-section to operate in similar fashion.

The reinforcing band 40 is of a thin and therefore highly flexible and bendable material which, on the other hand, is relatively unstretchable, e.g. a tightly unwoven, non-stretchable fabric, such as nylon fabric. But the particular material is not critical, so long as it has the required characteristics of flexibility and non-stretchability.

Each band section 41, 42 in the shoe illustrated is approximately ½" wide and 4" in length between the center seam 37 and the respective lace hole row 26 on that side of the shoe.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A shoe comprising:

a shoe upper including a bottom beneath, sides passing up past the sides of, and a top above a wearer's foot; the shoe upper including a front portion, a heel portion and a foot opening at the heel portion; the shoe upper being comprised of a flexible material at least at the mid-section of the shoe upper;

a split sole beneath the bottom of the shoe upper including a front sole portion under the front portion of the shoe upper, a rear sole portion under the heel portion of the shoe upper, a mid-section of the bottom of the shoe upper between the front and the rear sole portions and which is without the sole beneath it;

a band of flexible, non-stretchable material attached to the shoe upper so as to overlap the shoe upper at the mid-section of the shoe upper, the band extending across the bottom of the shoe upper, up past both sides of the shoe upper and extending to and attached in an overlapping arrangement to both sides of the shoe upper toward the top of the shoe upper for substantially reducing an amount of sagging of the bottom of the shoe upper due to application of force to the bottom of the shoe upper by the wearer's foot and due to stretching of the shoe upper material.

2. The shoe of claim 1, wherein at the bottom of the shoe upper, the band does not extend forward past the front sole portion or rearward past the rear sole portion.

3. The shoe of claim 1, wherein the band is attached to the bottom, to the sides and on the top of the shoe upper.

4. The shoe of claim 3, further comprising means attaching the band to the shoe upper at the bottom, side and top of the shoe upper.

5. The shoe of claim 4, wherein the attaching means comprises the band being stitched to the shoe upper.

6. The shoe of claim 5, wherein the band has a front edge toward the front portion of the shoe upper and a rear edge toward the heel portion of the shoe upper and the stitching is at the front and rear edges of the band.

7. The shoe of claim 3, wherein the shoe upper has an inside and outside and the band is disposed on the inside of the shoe upper.

8. The shoe of claim 7, wherein the band is comprised of a respective band section extending from the bottom of the shoe upper and up each side of the shoe upper.

9. The shoe of claim 3, wherein the top of the shoe upper is split, and means are provided at the top of the shoe upper for drawing the split shoe upper together for tightening the shoe on the wearer's foot and additionally for pulling up the band.

10. The shoe of claim 1, wherein the top of the shoe upper is split, and means are provided at the top of the shoe upper for drawing the split shoe upper together for tightening the shoe on the wearer's foot and additionally for pulling up the band.

11. The shoe of claim 1, wherein the band is comprised of a flexible essentially non-stretchable fabric.

12. The shoe of claim 11, wherein the band is comprised of nylon.

13. The shoe of claim 12, wherein the shoe upper is comprised of leather.

14. The shoe of claim 11, wherein the shoe upper is comprised of an elastic fabric material.

15. The shoe of claim 3, wherein the band is comprised of a respective band section extending from the bottom of the shoe upper up each side of the shoe upper.

16. The shoe of claim 15, wherein each band section extends obliquely forward from beneath the arch of the wearer's foot to the top of the shoe upper in front of the foot opening.

* * * * *